US012134016B2

(12) United States Patent
Hall et al.

(10) Patent No.: US 12,134,016 B2
(45) Date of Patent: Nov. 5, 2024

(54) PORTABLE BASKETBALL GOAL ASSEMBLY

(71) Applicant: Russell Brands, LLC, Bowling Green, KY (US)

(72) Inventors: Jason Hall, Bowling Green, KY (US); Randy C Peterson, Victoria, MN (US); Louis Polk, Excelsior, MN (US); Louis Polk, IV, St. Louis Park, MN (US); Benjamin Simms, Bowling Green, KY (US); Ronald White, Milwaukee, WI (US)

(73) Assignee: Russell Brands, LLC, Bowling Green, KY (US)

( * ) Notice: Subject to any disclaimer, the term of this patent is extended or adjusted under 35 U.S.C. 154(b) by 0 days.

(21) Appl. No.: 17/537,753

(22) Filed: Nov. 30, 2021

(65) Prior Publication Data

US 2022/0347537 A1 Nov. 3, 2022

Related U.S. Application Data

(60) Provisional application No. 63/181,323, filed on Apr. 29, 2021.

(51) Int. Cl.
*A63B 63/08* (2006.01)
*A63B 71/02* (2006.01)

(52) U.S. Cl.
CPC ..... *A63B 63/083* (2013.01); *A63B 2071/025* (2013.01); *A63B 2071/026* (2013.01); *A63B 2210/50* (2013.01)

(58) Field of Classification Search
CPC ..... A63B 63/083; A63B 2210/50; A63B 2225/093; A63B 2071/025; A63B 71/023;
(Continued)

(56) References Cited

U.S. PATENT DOCUMENTS 2,340,540 A * 2/1944 Lange ..... A47B 61/003 403/88
3,716,234 A * 2/1973 Lancellotti ..... A63B 63/083 248/346.03

(Continued)

FOREIGN PATENT DOCUMENTS

CN 201200776 Y 3/2009

OTHER PUBLICATIONS

International Search Report and Written Opinion for International Application No. PCT/US2022/011309.

*Primary Examiner* — Melba Bumgarner
*Assistant Examiner* — Amir A Klayman
(74) *Attorney, Agent, or Firm* — Jacob W Neu; Lucas R Yordy; Bradley Arant Boult Cummings LLP

(57) ABSTRACT

Disclosed herein is a basketball backboard system and methods of assembly. The backboard system reduces and simplifies the number of steps for a user to take in assembling the system for play. The basketball system comprises a base, a vertical support assembly including a pole, a backboard extension arm, a backboard, and a rim. In some embodiments, the user only has to complete five attachments to fully assemble the system, including securing the vertical support assembly to the base, securing the backboard extension arm to the pole, mounting the backboard to the extension arm, and mounting the rim to the backboard. It is further contemplated that the system will be convenient to package, as the vertical support assembly may be designed to fully nest within the base to reduce product volume.

17 Claims, 10 Drawing Sheets

(58) Field of Classification Search
CPC ..... A63B 69/0071; A63B 63/08; A63B 2243/0037; A63B 63/00; A63B 2210/56; A63B 2210/58; A63B 2071/026
See application file for complete search history.

(56) References Cited

U.S. PATENT DOCUMENTS 3,881,724 A * 5/1975 Beveridge ..... A63B 63/083 473/472
3,955,787 A * 5/1976 Brown ..... A47F 5/13 248/524
3,958,786 A * 5/1976 Mann ..... F16M 11/10 211/195
4,105,176 A * 8/1978 Hill ..... F16M 11/22 248/676
4,146,897 A * 3/1979 Wilson ..... H01Q 1/084 343/882
4,404,565 A * 9/1983 Gurney ..... H01Q 15/16 343/882
4,466,613 A * 8/1984 Reese ..... A63B 21/1609 482/129
4,490,934 A * 1/1985 Knapp ..... G09F 7/00 40/610
4,555,827 A * 12/1985 St. Louis ..... B60B 33/06 16/33
4,656,486 A * 4/1987 Turner ..... H01Q 1/125 343/915
4,706,087 A * 11/1987 Holznagel ..... E01F 9/615 340/908
4,735,392 A * 4/1988 Farmer ..... B25H 5/00 248/439
4,869,501 A * 9/1989 Anastasakis ..... A63B 63/083 473/483
4,946,163 A * 8/1990 Aakre ..... A63B 63/083 473/483
5,100,132 A 3/1992 Anderson et al.
5,102,128 A * 4/1992 Geise ..... A63B 63/083 473/483
5,221,089 A * 6/1993 Barrett ..... A63B 69/0059 473/409
5,259,612 A * 11/1993 Matherne ..... A63B 71/023 473/484
5,377,976 A * 1/1995 Matherne ..... A63B 63/083 473/483
5,390,914 A * 2/1995 Schroeder ..... A63B 63/083 473/483
5,415,393 A * 5/1995 Fitzsimmons ..... A63B 71/023 248/528
5,525,000 A * 6/1996 Belobraydich ..... G09F 15/00 403/325
5,584,480 A * 12/1996 Grimsrud ..... A63B 71/023 473/484
5,760,751 A * 6/1998 Gipson ..... H01Q 1/1235 343/890
5,836,838 A * 11/1998 van Nimwegen ... A63B 63/083 473/481
5,893,809 A * 4/1999 Coats ..... A63B 63/083 473/486
5,902,197 A * 5/1999 Davis ..... A63B 63/083 473/479
5,947,847 A * 9/1999 van Nimwegen ... A63B 63/083 473/481
5,966,104 A * 10/1999 Massey ..... H01Q 15/161 343/915
5,967,523 A * 10/1999 Brownlee ..... F41J 1/10 273/407
6,001,034 A * 12/1999 Schickert ..... A63B 63/083 473/472
6,019,690 A * 2/2000 Parr ..... A63B 63/083 473/481
6,053,825 A * 4/2000 Allen ..... A63B 63/083 473/479
6,188,372 B1 * 2/2001 Jackson ..... H01Q 19/132 343/882
6,474,617 B1 * 11/2002 Sahertian ..... E04H 12/2238 52/121
6,484,987 B2 * 11/2002 Weaver ..... F16M 11/2028 248/278.1
6,630,912 B2 * 10/2003 Ehrenberg ..... H01Q 1/1235 343/882
6,734,830 B1 * 5/2004 Bickham ..... H01Q 19/13 248/910
6,932,725 B2 * 8/2005 Monsen ..... A63B 71/023 473/483
6,991,568 B1 * 1/2006 Tien ..... A63B 63/083 267/140
7,001,291 B2 * 2/2006 Carey ..... B60R 9/08 473/481
7,046,210 B1 * 5/2006 Brooker ..... H01Q 3/08 343/882
7,331,882 B1 * 2/2008 White ..... A63B 63/083 473/481
7,439,930 B2 * 10/2008 Bury ..... H01Q 3/04 343/882
7,674,194 B2 * 3/2010 Lortscher ..... A63B 69/0075 473/422
7,691,014 B2 * 4/2010 Nye ..... A63B 63/083 473/481
7,691,015 B2 * 4/2010 Nye ..... A63B 63/083 473/483
7,717,377 B1 * 5/2010 Corrado ..... G10G 5/00 248/150
7,736,246 B2 * 6/2010 Lortscher ..... A63B 69/0002 473/422
8,161,890 B2 * 4/2012 Wang ..... A47B 23/043 108/115
9,171,487 B2 * 10/2015 Adams ..... G09F 7/22
9,295,866 B2 * 3/2016 Kwo ..... A63B 71/023
9,972,205 B2 * 5/2018 Beaulieu ..... E01F 9/30
10,040,600 B1 * 8/2018 Robbins ..... B65D 81/36
2004/0018900 A1 1/2004 Monsen
2005/0164847 A1 * 7/2005 Giusti ..... A63B 69/20 482/86
2006/0183574 A1 * 8/2006 Stanford ..... A63B 63/083 473/481
2006/0293125 A1 * 12/2006 Nye ..... A63B 63/083 473/483
2007/0042843 A1 * 2/2007 Nye ..... A63B 63/083 473/481
2007/0191148 A1 * 8/2007 Shannon ..... A63B 71/023 473/483
2007/0232421 A1 * 10/2007 Nye ..... A63B 63/083 473/481
2007/0238559 A1 * 10/2007 Nye ..... A63B 63/083 473/481
2012/0252607 A1 * 10/2012 Shepherd ..... A47B 83/024 473/483
2017/0128804 A1 * 5/2017 Bruce ..... A63B 71/0036
2017/0136327 A1 * 5/2017 Nguyen ..... A63B 63/083
2019/0118055 A1 * 4/2019 Greiner ..... A63B 71/0036

* cited by examiner

PORTABLE BASKETBALL GOAL ASSEMBLY

CROSS-REFERENCE TO RELATED APPLICATION

This application cites the priority of U.S. 63/181,323 filed 29 Apr. 2021. U.S. 63/181,323 is incorporated herein by reference in its entirety.

TECHNICAL FIELD

The present disclosure pertains generally to basketball backboard systems and methods of assembly. More particularly, the disclosure relates to a basketball backboard system that can be assembled in a quick and easy manner, and which can be conveniently packaged in a compact volume for shipping.

TECHNICAL BACKGROUND

Basketball is a commonly enjoyed recreational, amateur, and professional sport. Oftentimes, portable basketball backboard systems are used for recreational or consumer basketball play. A portable backboard system typically includes a movable base, a vertical support or pole assembly deployed on and attaching to the base, and a basketball backboard and rim assembly attached to the top of the pole assembly that a user may move to a desired location. The system is designed to be portable, such that a user may move the backboard system to a desired location to play basketball. When not in use, the portable nature of the system allows the user to move the system to a convenient storage location.

One common drawback of portable basketball backboard systems is the significant time and difficulty associated with assembly. It often takes 3-5 hours to construct a common portable system due to the number of discrete parts forming the sub-assemblies and final assembly of the system. When these parts are shipped in a disassembled manner, the user must first spend significant time locating parts in the carton, sorting and identifying the parts, identifying hardware, perusing instructions, and assembling the system for play. Such assembly requires longer and more complex instructions, text, and images, which increases the potential for miscommunicating assembly steps to the user or causing user confusion. In addition, some products require specialized tools such as deep well sockets and socket extensions.

On the other hand, providing the system to the consumer in a more assembled state is disadvantageous for purposes of shipping due to the shape of the system parts. For example, the base of the system is wide, the vertical support or pole assembly is tall and narrow, and the backboard is large and rectangular—all shapes and sizes that are difficult to ship directly to consumers. Thus, it is both difficult and costly to ship a partially or mostly assembled portable backboard system.

What is needed, then, is a portable basketball backboard system that can be assembled in an easy and quick manner, and which can be shipped partially or mostly assembled, while maintaining a compact volume for shipping.

BRIEF SUMMARY OF INVENTION

In some instances, the invention concerns a backboard system for assembly comprising a base having a top surface and at least one indentation in the top surface; a vertical support assembly including a pole, an extension arm, a backboard, and a rim. The vertical support assembly may comprise a hinge assembly; two front legs, each having an upper end secured to the hinge assembly and a lower end securable to the base; two back legs, each having an upper end secured to the hinge assembly and a lower end secured to the base; and a pole having a bottom end secured to the hinge assembly and a top end. The system may be convenient to package, as the vertical support assembly may be fully nested within the indentation in the base, thereby reducing volume for packaging.

Also contemplated herein are methods for assembling a basketball backboard system. The method comprises providing a backboard system, such as that described above; mounting a backboard to the pole; mounting a rim to the backboard; rotating the front legs to a position wherein the lower end of each front leg is securable to the base, and the upper ends of the front legs and of the back legs and the hinge assembly is raised above the base; securing the front legs to the base; rotating the hinge assembly until the pole is in a vertical position; and locking the pole in a vertical position. The systems and methods for assembly disclosed herein are designed to reduce and simplify the number of steps for a user to take in assembling the system for play.

The invention is directed to other aspects as may be determined from the detailed description below.

BRIEF DESCRIPTION OF DRAWINGS

To aid in the appreciation of further advantages and features of the present disclosure, a more particular description will be provided by reference to specific embodiments, which are illustrated in the appended drawings. It is appreciated that these drawings are not to be considered limiting in scope. The disclosure herein will be described and explained with additional specificity and detail through the use of the accompanying drawings.

DETAILED DESCRIPTION

This detailed description is provided for amplifying the invention and aiding in understanding of the disclosure, by reference to possible embodiment(s). The invention shall not be interpreted as limited to any particular embodiment shown, except as set forth in the claims.

This document provides materials for designing and assembling a portable basketball backboard system 10 that reduces and simplifies the number of steps for a user to take in preparing the assembly for play.

Figure 1:
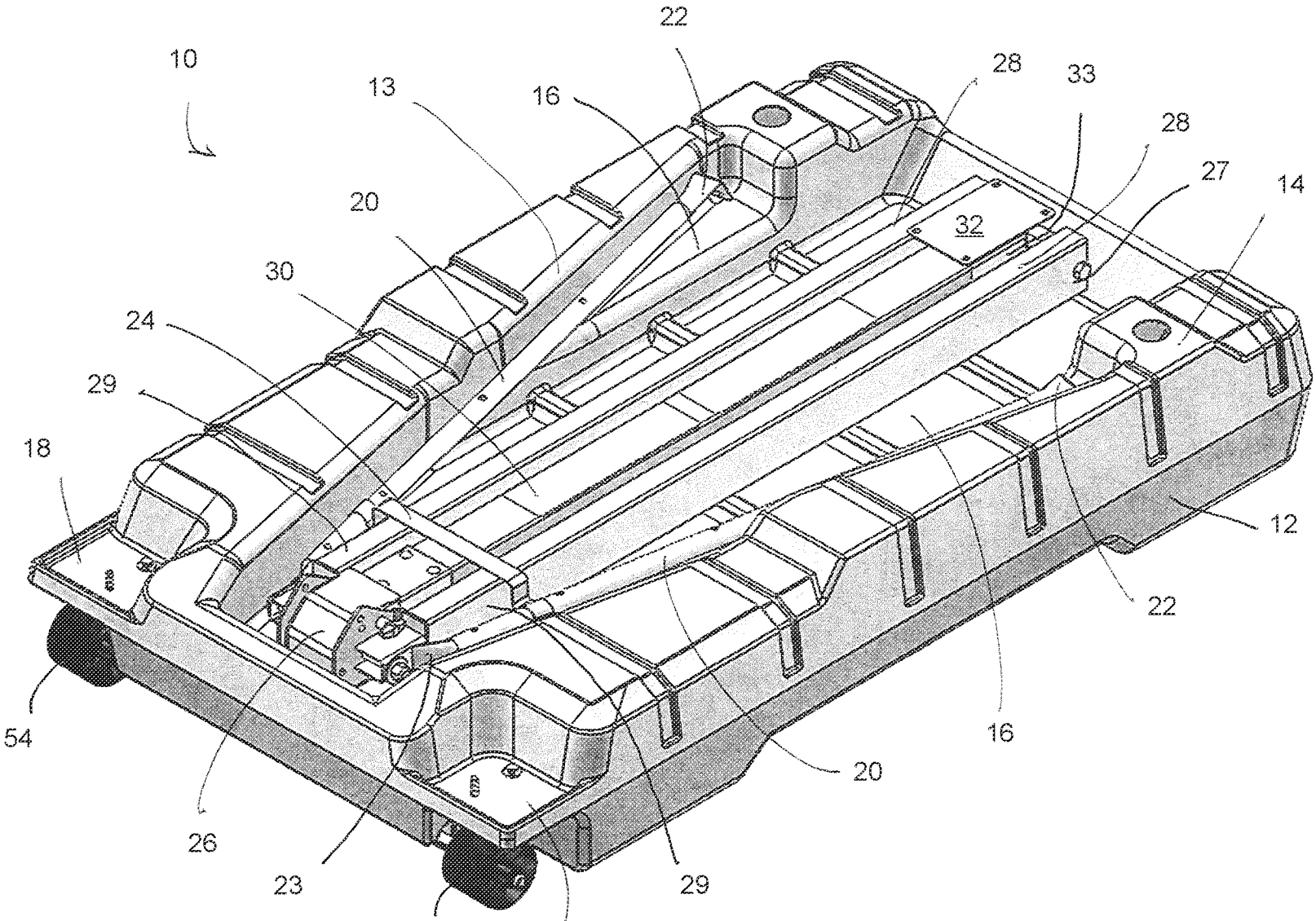
FIG. 1 is a perspective view a basketball system base and pole assembly, according to an embodiment of the invention.

FIG. 1 depicts a basketball backboard system 10 as it may be shipped to a user and as it may be at the beginning of the assembly process. As can be seen in FIG. 1, the basketball backboard system 10 comprises a vertical support assembly 13 (also referred to as a pole assembly 13) disposed on a base 12. The base 12 has a substantially rectangular profile when viewed from the top, bottom, and the four sides. Such a profile is particularly advantageous for fitting a shipping box or other container. The base 12 has a top surface 14 having at least one indentation 16. More particularly, the indentations 16 comprise recessions in the top surface 14 that are dimensioned such that parts of the pole assembly 13 may be at least partially nested within the indentations 16. In some embodiments, when the pole assembly parts are disposed within the recessed indentations 16 on the top surface 14 of the base 12, the pole assembly parts are completely disposed within the indentations 16. That is, when nested, the pole assembly parts do not rise above the top surface 14 of the base 12. Such nesting is particularly advantageous for shipping the basketball backboard system 10 to a consumer. Because the pole assembly parts may be nested within the base 12, the shipping profile of the basketball backboard system 10 is substantially that of the base 12, i.e., a generally rectangular shape.

The base 12 may be constructed of any rigid material, such as metal, wood, or plastics. In some embodiments, the base 12 may be made of a molded polyethylene plastic. The base 12 may have a hollow interior such that a ballast, such as sand or liquid, may be placed by the user within the base 12. The ballast serves to weigh down the base 12 to improve stability. In some embodiments, the base 12 may have various interior compartments portioned by hollow ribs. The presence of ribs on the base 12 may provide additional structural support and rigidity to the base 12.

The base 12 may further comprise castors 54 or wheels 54 to assist the user in moving the basketball system 10 to a desired location, thus making the system 10 portable. The base 12 may have any number of castors 54 or wheels 54. In some embodiments, such as that shown in FIG. 1, two wheels 54 are affixed to two opposing corners of the base 12. The opposing corners may be those framing the breadth (i.e., one of the short sides) of the substantially rectangular base 12. In such embodiments, the user may move the basketball system 10 by lifting the base 12 in such a manner that only the wheels 54 remain in contact with the ground. The user may then guide the basketball system 10 into a desired location using the wheels 54.

The vertical support assembly 13 has one or more parts that, once assembled, extend upward from the base 12 to support a basketball backboard 38. For ease of shipment, the vertical support assembly 13 may have a number of parts, with each part being no longer than the longest dimension of the base 12, such that the parts can fit within the same shipment box as the base 12. Furthermore, to reduce assembly steps for an end user, the system 10 may be shipped or purchased with the vertical support assembly 13 partially or fully pre-assembled. That is, different parts of the vertical support assembly 13 may be connected to each other and/or to the base 12 prior to receipt by the customer. Additionally, as described in further detail below, the system 10 may be shipped with the vertical support or pole assembly 13 nested within the indentations 16 in the top surface 14 of the base 12.

As depicted in FIG. 1, the vertical support assembly 13 may comprise two front legs 20, two back legs 28, a hinge assembly 26, and a pole 30, each of which are described further herein. Beginning with the front legs 20, each front leg 20 in the embodiment of FIG. 1 has a first end 22 securable to the top surface 14 of the base 12 and a second end 23 securable to the hinge assembly 26. Each second end 23 may be rotatably secured to the hinge assembly 26 such that the front legs 20 may rotate in relation to the hinge assembly 26. Each first end 22 is securable to the top surface 14 of the base 12 at a platform 18 located on the base 12 above the castors 54 (see connection in FIG. 5). In this embodiment, the customer will connect the first end 22 of each front leg to one of the platforms 18 as described further herein. In some embodiments, the front legs 20 may be connected via a brace 24 to provide additional structural stability. As shown in FIG. 1, the brace 24 may be located on or near the second ends 23 of the front legs 20 and the hinge assembly 26.

The basketball system 10 may be designed such that the first ends 22 and/or the second ends 23 of the front legs 20 are secured to the base 12 prior to shipping to a customer. The customer would then be responsible for securing the unattached ends, as applicable, during assembly of the basketball system 10. In the embodiment depicted in FIG. 1, the front legs 20 are stored within the recessed indentations 16 of the base 12, with the second ends 23 of the front legs 20 secured to the hinge assembly 26 prior to shipment. Then, to assemble the system 10, the customer will lift the front legs 20 up (thereby removing the legs 20 from the indentations 16) and then connect the first ends 22 of the front legs 20 to the platform 18, as shown in the assembly stage depicted in FIG. 5. Further, in embodiments having the brace 24, the brace 24 may also be affixed to the front legs 20 prior to shipment.

As depicted in FIG. 1, the vertical support assembly 13 may also have a pair of back legs 28. The back legs 28 each have a first end 27 rotatably securable to the top surface 14 of the base 12 and a second end 29 rotatably secured to the hinge assembly 26. As shown in FIG. 1, the system 10 may be shipped with the back legs 28 nested into the indentations 16. Further, the system 10 may be shipped with the back legs 28 already secured to both the base top surface 14 and the hinge assembly 26 (see, e.g., FIG. 1). In other embodiments, the back legs 28 may be shipped without the first ends 27 and/or second ends 29 secured to the base 12 and hinge 26, respectively, such that the customer would be responsible for making these connections during assembly of the system 10. For examples, if the system 10 is shipped with the front legs 20 attached to the base 12, then the system 10 may be designed such that the back legs 28 are not attached to the base 12 and/or to the hinge assembly 26 at the time of shipment.

The basketball system 10 depicted in FIG. 1 has a vertical support assembly 13 having a total of four legs: two front legs 20 and two back legs 28. As detailed earlier herein, each leg has a first end secured or securable to the base 12 and a second end secured or securable to the hinge assembly 26. In other embodiments, the vertical support assembly 13 may have more or fewer legs. For example, the vertical support assembly 13 may have more than four legs, such as an embodiment having two front legs, two back legs, and a centrally located middle leg. In other embodiments, the vertical support assembly 13 has less than four legs. For example, the vertical support assembly 13 may have three legs in the form of a tripod (e.g., one centrally located front leg and two back legs, or two front legs and one centrally located back leg). Two legs and single leg embodiments are also possible. For example, single leg embodiments may comprise a single pole, which is potentially telescoping to provide the appropriate height. Two legs and single leg embodiments may require extra stabilization or support on the base 12 by additional means.

As detailed above, the legs 20, 28 of the vertical support assembly 13 are connected to a hinge assembly 26 disposed on the top surface 14 of the base 12. As shown in FIG. 1, the second end of each leg 20, 28 may be rotatably secured to a hinge bracket 44, which forms the outermost portion of the hinge assembly 26. Also secured to the hinge bracket 44 is a first end 31 of a pole 30 (see FIG. 2). Like the legs 20, 28, the pole 30 may be nested within an indentation 16 in the top surface 14 of the base 12. As shown in FIG. 1, when nested, the pole 30 may be placed between the two back legs 28. The top end 33 of the pole 30 has an attachment plate 32 for securing an extension arm 34.

The embodiment shown in FIG. 1 depicts a configuration of how a user may receive the base 12 and vertical support assembly 13 "out of the box," that is, as received from shipment or from pick-up from the store. As mentioned previously, the vertical support assembly 13 (e.g., front legs 20, back legs 28, hinge assembly 26, and pole 30) may be nested within indentation(s) 16 in the top surface 14 of the base 12. In the embodiment depicted in FIG. 1, the vertical support assembly 13 is nested completely within at least one recessed indentation 16 in the top surface 14 of the base 12.

Figure 2:
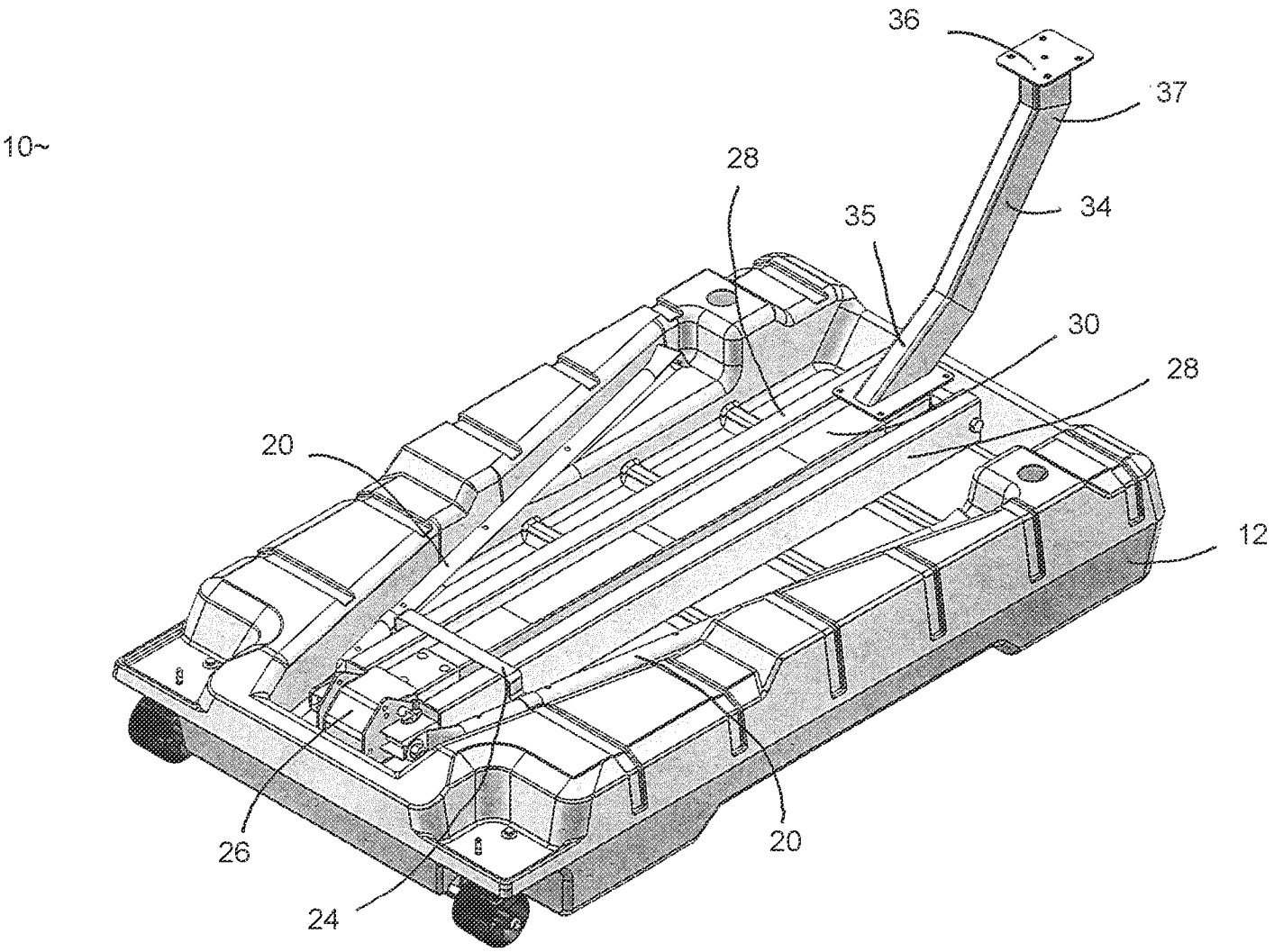
FIG. 2 is a perspective view of the basketball base and pole assembly in a first step of assembly, according to an embodiment of the invention.
Figure 3:
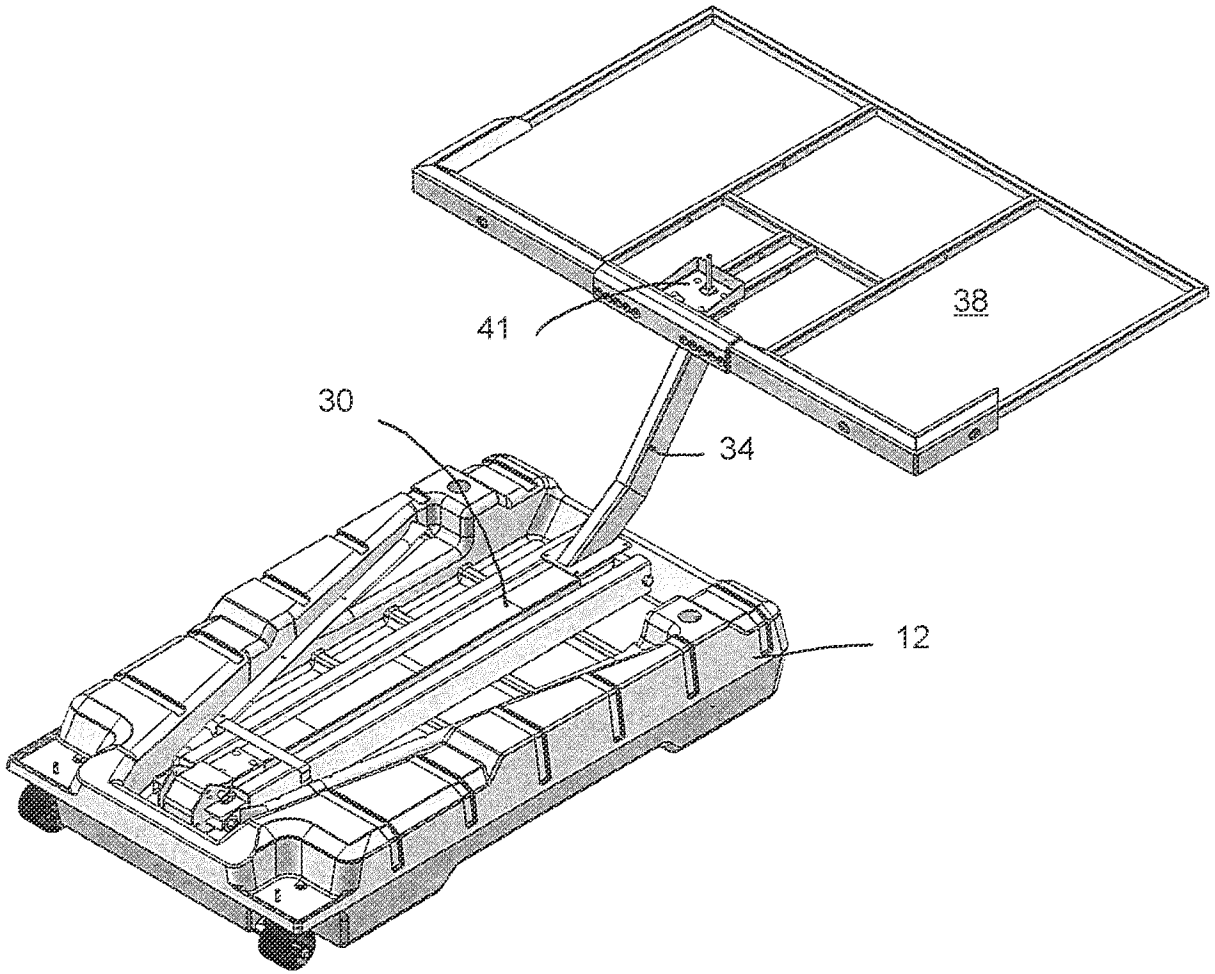
FIG. 3 is a perspective view of the basketball base and pole assembly in a second step of assembly, according to an embodiment of the invention.
Figure 4:
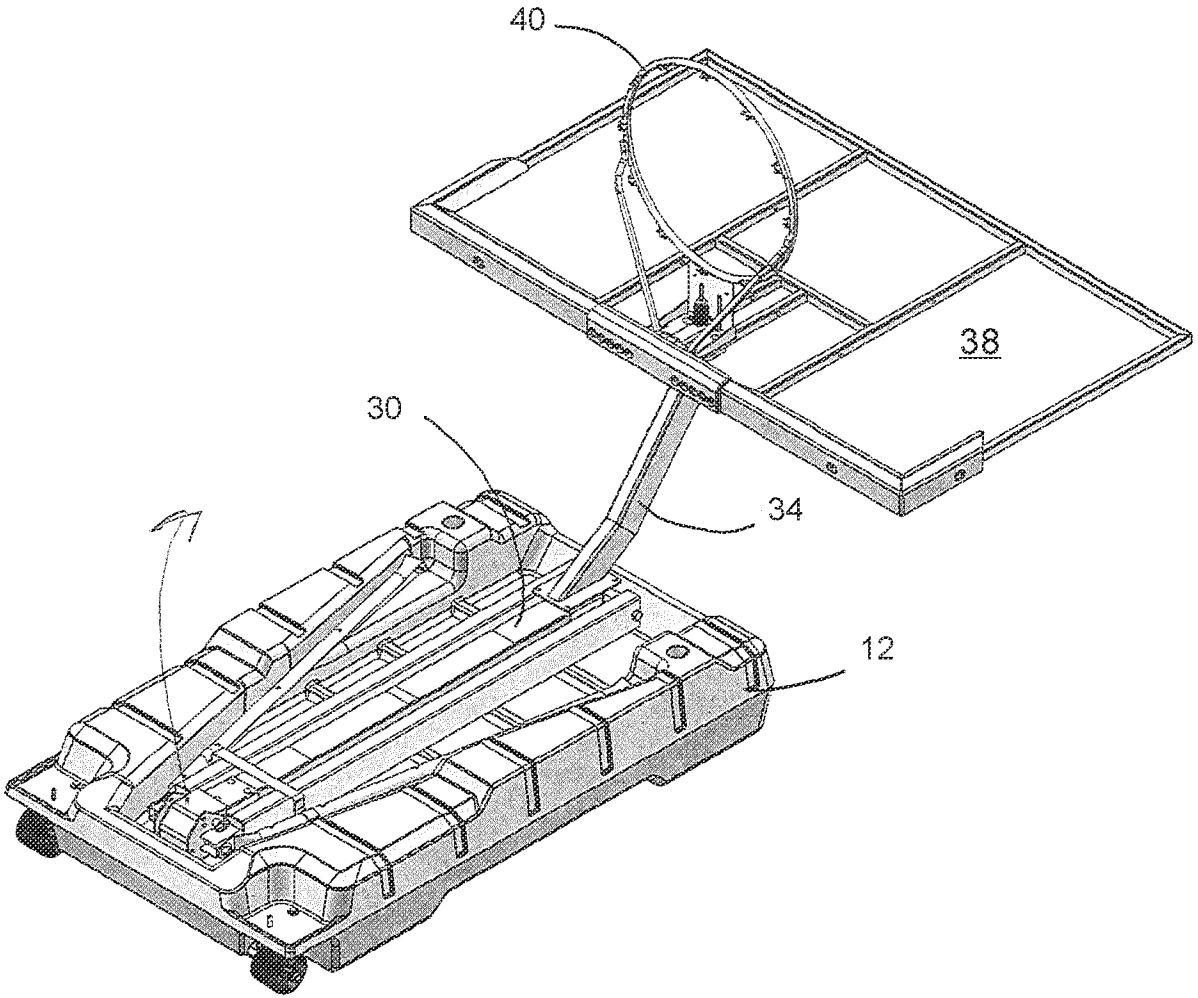
FIG. 4 is a perspective view of the basketball base and pole assembly in a third step of assembly, according to an embodiment of the invention.

To be "completely" nested within the base 12 means the entirety of an element is flush with or below the top surface 14 of the base 12. As depicted in FIGS. 1-3, while nested, the back legs 28 and hinge assembly 26 are arranged such that the hinge assembly 26 folds completely within and between back legs 28. The pole 30 may also be nested between the back legs 28. In other embodiments, a single back leg 28 may be used, provided that the back leg 28 and hinge assembly 26 remain completely nested within at least one indentation 16 when prepared for shipment or purchase.

In some embodiments, the front legs 20 may be completely nested in the same or different indentations 16 as the back legs 28. For example, in FIGS. 1-3, the back legs 28, hinge assembly 26, and pole 38 are nested within a centrally disposed indentation 16 and the front legs 20 are separately nested in angled, sloping indentations 16 that flank the centrally disposed indentation 16. Specifically, the second ends 23 of the two front legs 20 are connected to opposing sides of the hinge assembly 26, which is located in the centrally disposed indentation 16. The two front legs 20 are positioned in side indentations 16 (one leg 20 per side indentation 16) that flank the centrally disposed indentation 16 and slope upwards and away from the centrally disposed indentation 16 beginning at approximately the location of the hinge assembly 26. Thus, in said embodiments, the parts of the vertical support assembly 13 are completely nested in the base 12 in multiple indentations 16.

Because of the nesting, the base 12 and vertical support assembly 13 may be shipped together to an end user in a single generally rectangular shipping box or container, which is convenient, efficient, and minimizes waste. Other components of the basketball system 10, such as an extension arm 34, backboard 38, and rim 40, may be shipped separately, either as separate parts in the same box, or in a different box or shipping container.

To minimize the number of assembly steps for the customer after receipt, the base 12 and the vertical support assembly 13 may be shipped or packaged partially or fully pre-assembled. For example, the first ends 27 of the back legs 28 may be rotatably secured by a bolt to the base top surface 14, and/or the second ends 29 of the back legs 28 may be rotatably secured to the hinge assembly 26. Alternatively or additionally, the front legs 20 may be rotatably secured to the hinge assembly 26. The pole 30 may also be secured to the hinge assembly 26. When partially or fully pre-assembled, one or more of the components of the vertical support assembly 13 may be designed to eliminate "pinch points" when rotating or folding, in compliance with prevailing playground equipment safety standards, which are incorporated herein by reference.

Upon receipt, the user may then begin assembling any non-preassembled parts to set up the basketball backboard system 10 for play. For example, FIGS. 1-6 depict potential steps in an assembly process of the system 10. In the embodiments shown in the aforementioned figures, the user receives a partially preassembled system 10. Specifically, the user first receives the parts necessary for constructing the system 10, which includes, as shown in FIG. 1, the base 12 containing a nested vertical assembly 13 (the other parts of the system 10 are not shown in FIG. 1). The vertical assembly 13 is already partially assembled and connected to the base 12. That is, the second ends of both the front and back legs 20, 28 are already rotatably secured to the hinge assembly 26. Further, the front ends 27 of the back legs 28 are also rotatably secured to the top surface 14 of the base 12. Finally, the first end 31 of the pole 30 is already secured to the hinge assembly 26, and an attachment plate 32 is affixed to the top end 33 of the pole 30 (i.e., the other end of the pole).

Upon receipt of the foregoing, the customer would then be responsible for further assembly of the system 10. For example, FIG. 2 depicts a potential next step in the user assembly process. In the step shown in FIG. 2, a user mounts a backboard support, such as an extension arm 34, to the pole 30, while the pole 30 is still nested in the base 12. The extension arm 34 extends between the pole and a basketball board 38, connecting the two. To mount the extension arm 34 to the pole 30, a user will immovably secure a proximal end 35 of the extension arm 34 the attachment plate 32 on the pole 30, such as by screws or bolts through the plate 32. As shown in FIG. 2, once secured in place, the extension arm 34 extends away from the base 12 in a generally perpendicular manner. The distal end 37 (i.e., the opposing end) of the extension arm 34 has a backboard attachment plate 36 for supporting a backboard 38 and rim 40. When the system 10 is assembled, the extension arm 34 cantilevers the backboard 38 away from the pole 30 and base 12. This cantilevered design permits play to proceed in the area directly underneath the backboard 38 and rim 40 while reducing the danger of a player tripping over the base 12.

Other designs for the backboard support are possible as well. For example, the backboard support may comprise two or more arms extending from the top of the pole 30 to the backboard 38 (not shown). Such a design may be used with particular lift mechanisms that permit a user to adjust the height of the rim 40 in connection with a non-adjustable or non-telescoping pole 30. Such lift mechanisms are typically more complex and require further assembly time on the part of the user. These lift mechanisms may be designed for and included in a quick-assembly system 10, such as that depicted in FIGS. 1-8 (mechanisms not shown in Figures). It is also possible that a backboard 38 could be secured directly to the pole 30 in lieu of the extension arm 34.

FIG. 3 depicts a potential next step in the user assembly process. In this step, a user may secure a backboard 38 to the backboard attachment plate 36 on the extension arm 34. In the embodiment shown in FIG. 3, the backboard 38 is directly attached to the backboard attachment plate 36 with bolts or screws. In some embodiments, the backboard 38 may connect to the backboard attachment plate 36 without direct attachment. For example, the backboard attachment plate 36 may have fixtures, such as pins or bolts, onto which the backboard 38 slides without direct attachment. In such embodiments, a rim 40 may also be attached via the same or similar fixtures on either the backboard 38 or the backboard attachment plate 36, and both the rim 40 and backboard 38 may be secured at the same time.

In a potential next step of assembly, the user affixes the rim 40 to the backboard 38. As can be seen in FIG. 3, the backboard 38 has a rim attachment plate 41 having a fixture, such as a pin or bolt, onto which the rim 40 may be mounted. The rim 40 may be mounted to the fixture with a spring and nut for use in a breakaway rim design, such as the embodiment shown in FIG. 4. Other rims, including non-breakaway rims, may be used as well.

Figure 5:
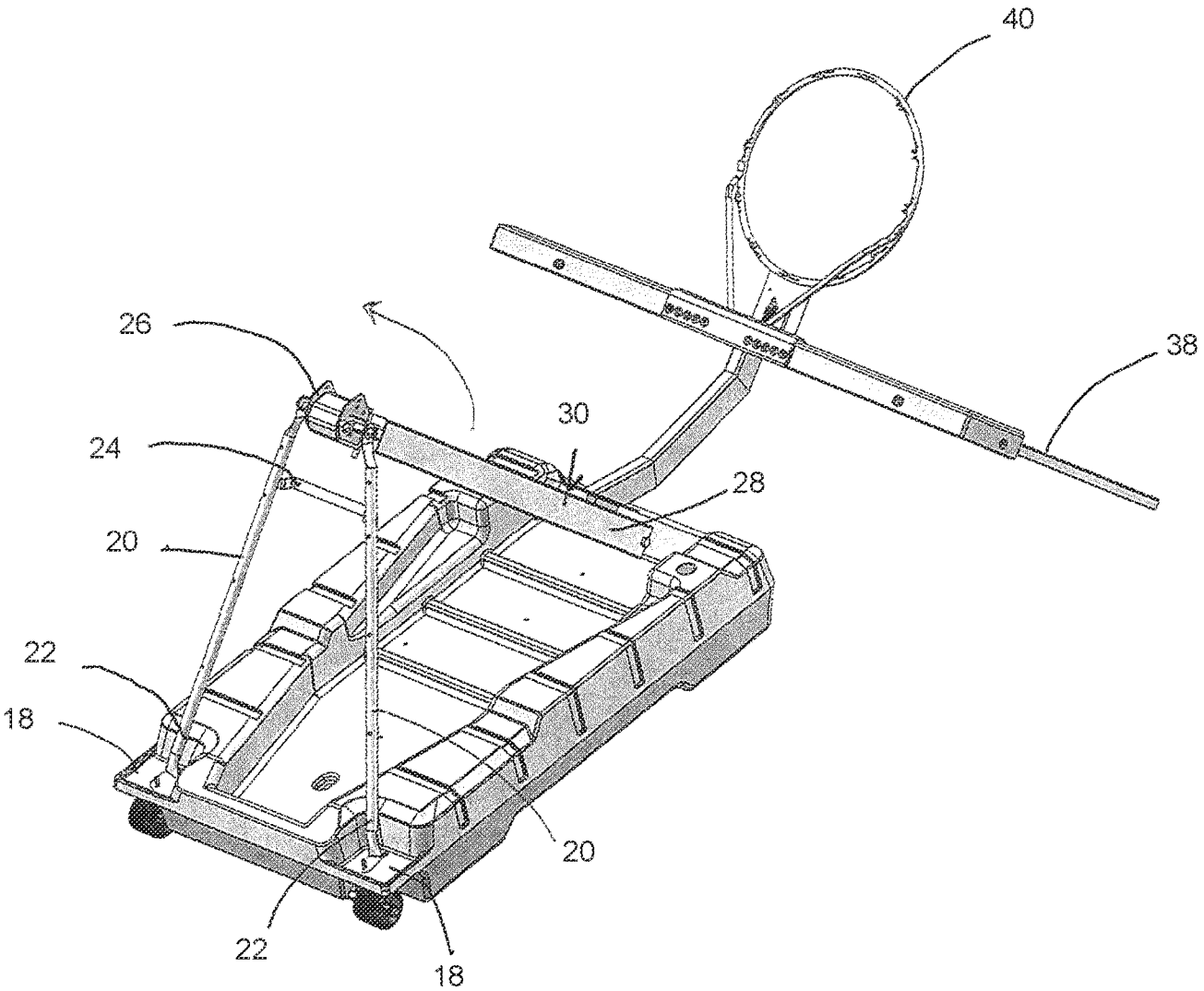
FIG. 5 is a perspective view of the basketball base and pole assembly in a fourth step of assembly, according to an embodiment of the invention.
Figure 6:
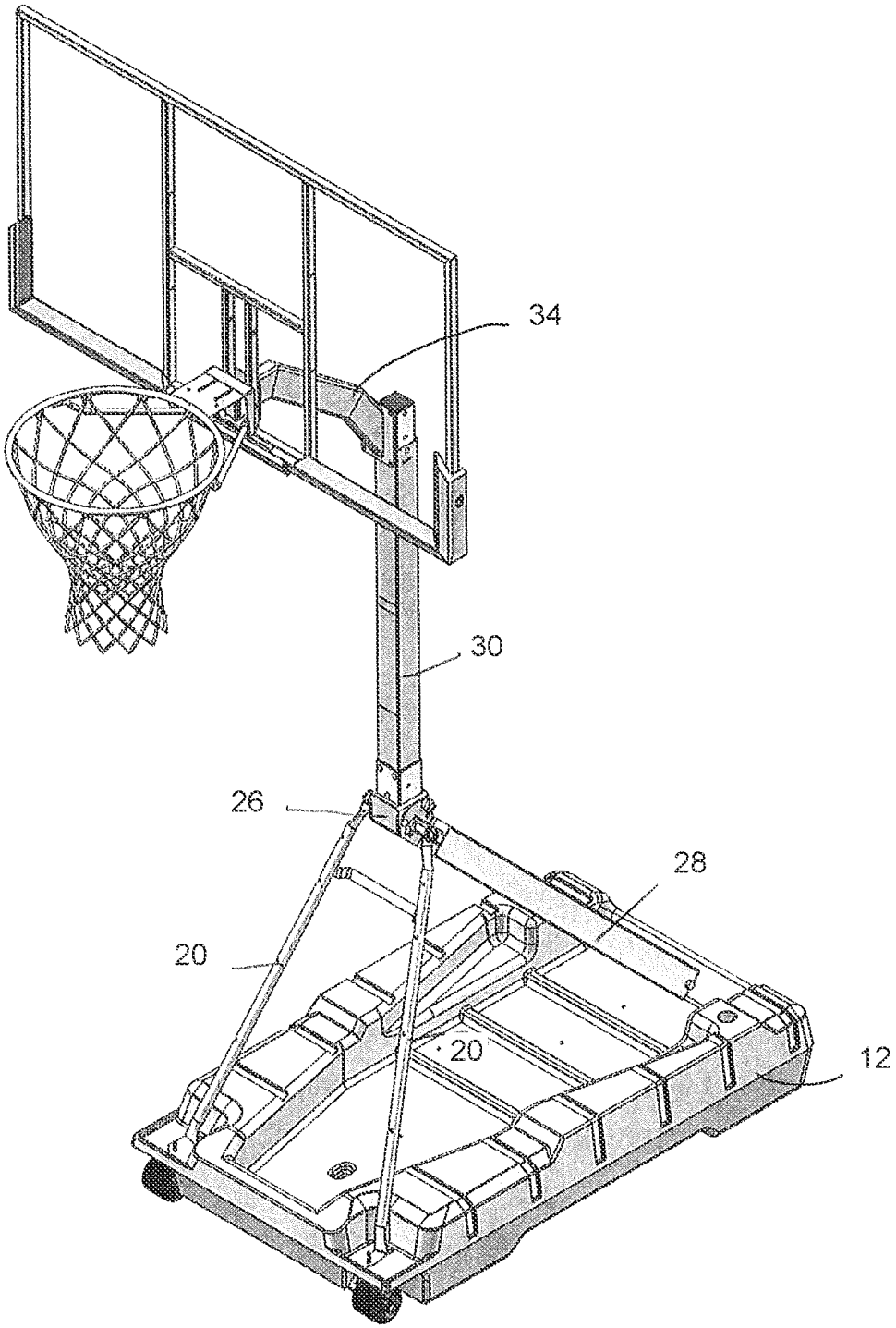
FIG. 6 is a perspective view of the basketball base and pole assembly in a fifth step of assembly, according to an embodiment of the invention.

In a potential subsequent step of assembly, the user raises the vertical support assembly 13, as shown in FIGS. 5 and 6. In the embodiment depicted herein, and as viewed from the perspective shown in FIGS. 1-5, the user lifts the front legs 20 up (thereby removing the legs 20 from the indentations 16 in the base 12), such that the second ends 23 of the front legs 20, which are connected to the hinge assembly 26, are raised above the first ends 22 of the front legs 20. That is, when the user raises the front legs 20, the front legs 20 are rotated counterclockwise around the hinge assembly 26, such that the first end 22 of each front leg 20 comes forward, and the second end 23 of each front leg 20 raises upwards with the hinge assembly 26. The counterclockwise rotation of the front legs 20 causes the back legs 28 to rotate in a clockwise manner, such that second ends 29 of the back legs 28, which are connected to the hinge assembly 26, are elevated above the first ends 29 of the back legs 28. Together, these motions may allow the front legs 20 to be positioned such that the first end 22 of each front leg 20 may be placed on and secured to, such as by pins or bolts, the base 12 and/or platforms 18 on the base 12. This secures the front legs 20 and stably raises the hinge assembly 26 up above the base 12. That is, when the front legs 20 are secured to the base 12, the front legs 20, the back legs 28, and the base 12 form a generally acute triangular shape when viewed from the side profile, which may be seen in FIG. 5. The base 12 forms the bottom of the triangle, and the front legs 20 and back legs 28 extend upwards from the base 12 to form the other two sides of the triangle, with the hinge assembly 26 positioned at the top of the triangle and disposed between the front legs 20 and the back legs 28.

Figure 10:
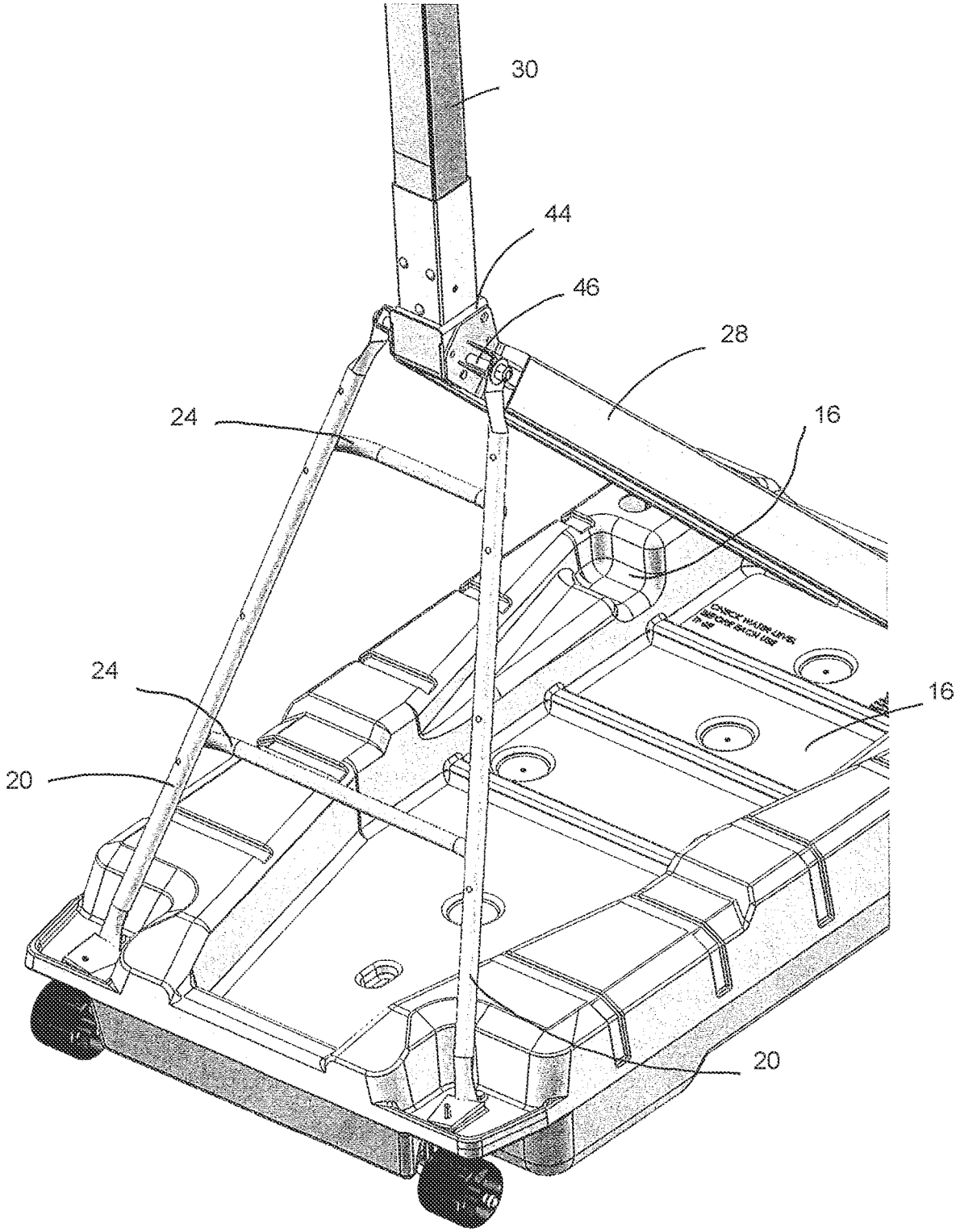
FIG. 10 depicts a perspective view of the basketball base and pole assembly according to an embodiment of the invention.

In some embodiments, such as that shown in FIGS. 5 and 6, at least one brace 24 may laterally connect the front legs 20. The brace 24 connects the front legs 20, such that the legs 20 rotate backward or forward together. This can assist the user in the aforementioned step of raising and securing the vertical assembly 13. That is, when a user raises the front legs 20, the brace 24 ensures that the legs 20 move stably together, thereby making it easier to assemble the system 10. Furthermore, the brace 24 provides additional rigidity and support to the overall structure of the system 10. In some embodiments, more than one brace 24 may connect the front legs 20, as seen in FIG. 10.

Next, FIG. 6 depicts a potential subsequent step in the assembly process. In this step, the user may raise the pole 30 upwards. In the embodiments depicted in FIGS. 5 and 6, the pole 30 is disposed between the back legs 28 and rotatably secured on one end to the hinge assembly 26. By lifting the pole 30, pole 30 may be rotated counterclockwise about the hinge assembly 26 until the pole 30 is vertical (i.e., generally perpendicular to both the base 12 and the playing surface). As shown in FIG. 6, when the pole 30 is raised to a vertical position, the rim 40 is generally parallel to the ground or playing surface. Once raised, the pole 30 may be fixed in place, such as by pins or bolts, so that the pole 30 does not readily fall backwards (i.e., rotate in a clockwise position back to its starting location). The locking of the pole in place is described in further detail below.

Figure 7:
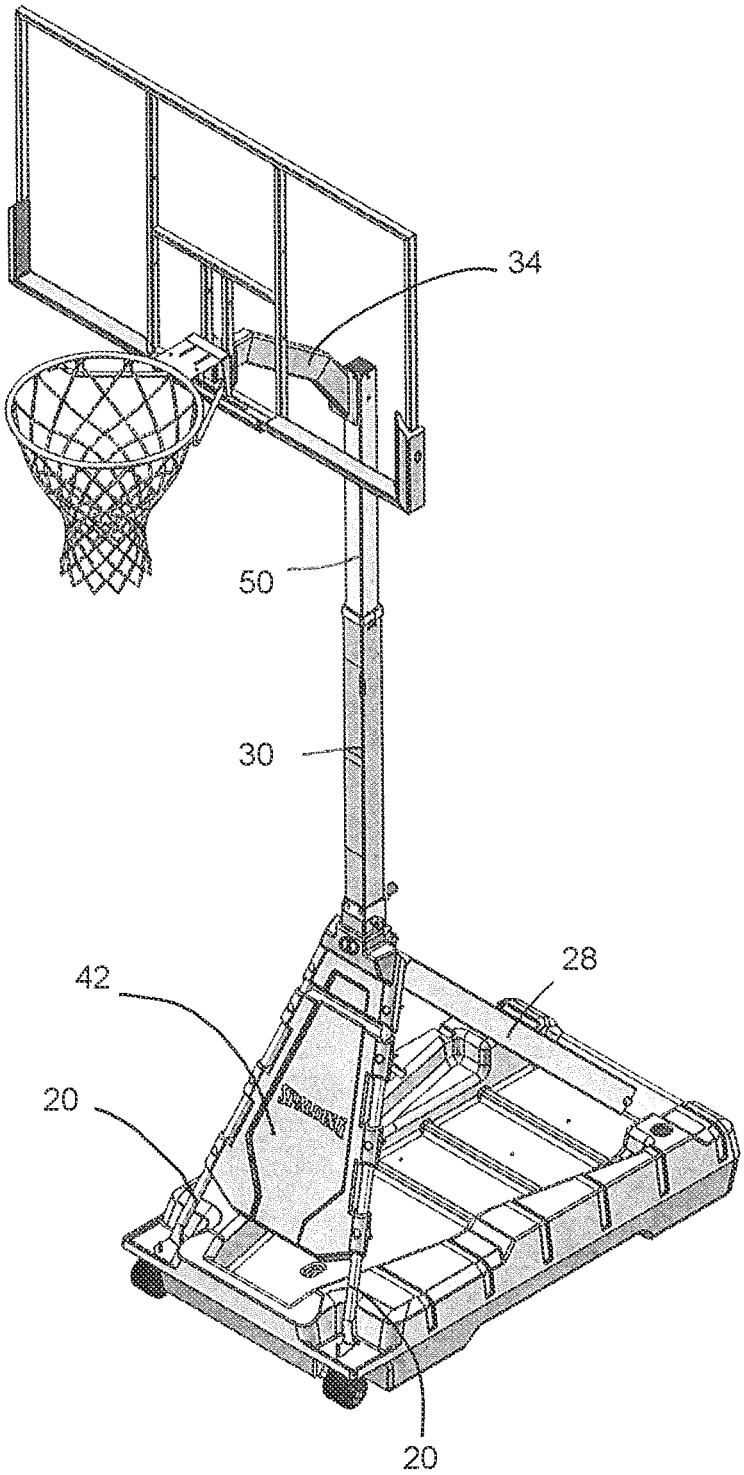
FIG. 7 is another perspective view of the basketball base and pole assembly in a fifth step of assembly, according to an embodiment of the invention.

In FIG. 7, the backboard system 10 is readied for play. If the pole 30 is a telescoping pole, as shown in FIG. 7, the pole 30 may comprise an interior telescoping pole 50 that may be raised upwards to lengthen the height of the pole 30 and, consequently, the height of the rim 40. In such embodiments, the backboard attachment plate 36 (and, therefore, the rim 40 and backboard 38) may affixed to the interior telescoping pole 50. The interior telescoping pole 50 may be lowered (or raised) depending on the desired playing height of the rim 40. For example, using the interior telescoping pole 50, the rim height may be adjusted to 10 feet, which is the height required for regulation basketball play, or the rim height may be adjusted to more or less than 10 feet depending on the height and/or age of the players. In other embodiments, a lift mechanism or system may be used to adjust the height of the rim 40.

In addition, as shown in FIG. 7, a bounce plate or surface 42 may be disposed between and/or across the front legs 20. When a basketball contacts the bounce plate 42, the basketball may bounce back in the general direction of the player(s). Because this may eliminate a player having to run to the system 10 to pick up the basketball to resume play, the bounce plate 42 may increase the ease and speed of game play.

Figure 8:
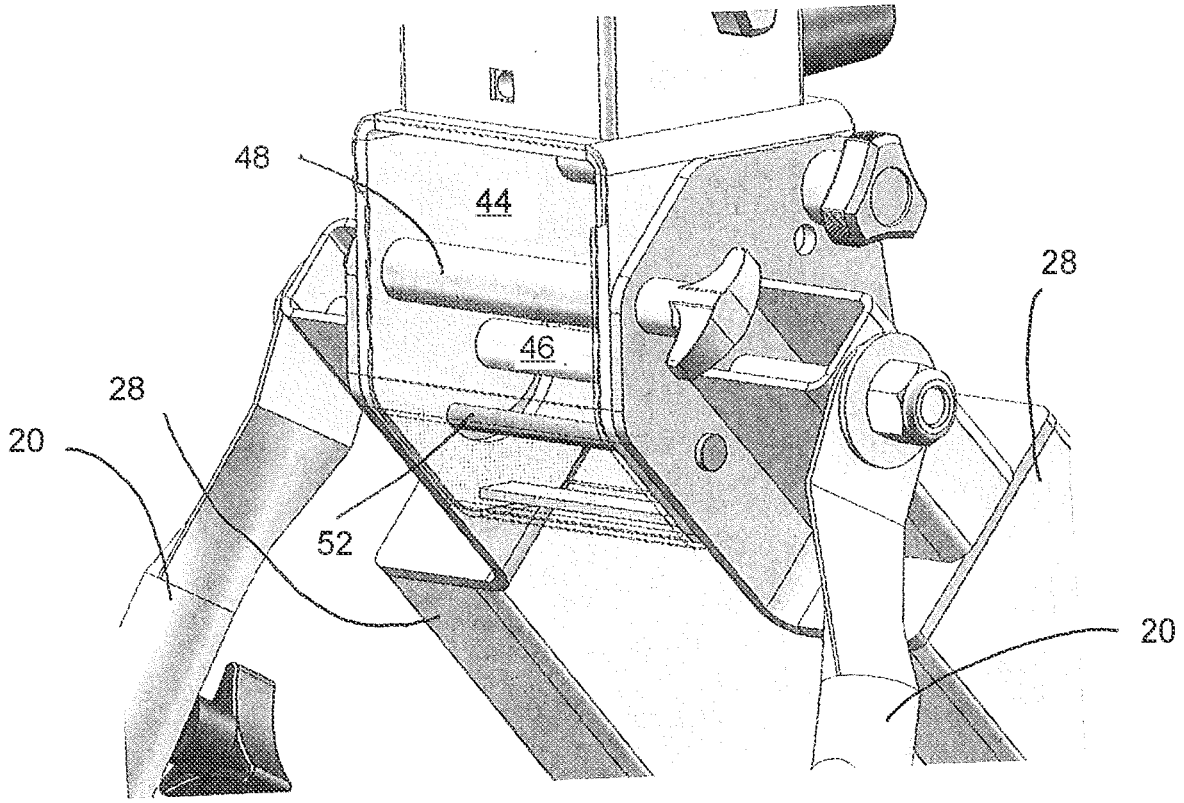
FIG. 8 is a close-up view of a hinge assembly for a vertical support, according to an embodiment of the invention.

FIG. 8 depicts an embodiment of the hinge assembly 26, as shown and described with reference to FIGS. 1-7, in further detail. In some embodiments, the hinge assembly 26 comprises a hinge bracket 44 rotatably set on a leg bolt 46. In such embodiments, the hinge bracket 44 may be U-shaped having a top and two sides defining an opening that extends from front-to-back of the hinge bracket 44. The front legs 20 and back legs 28 may be pinned to the outer side of the two sides of the U-shaped hinge bracket 44 by the leg bolt 46. Specifically, the leg bolt 46 is longer than the width of the hinge bracket 44, and the leg bolt 46 extends laterally through the hinge bracket 44, piercing through the right and left sides of the hinge bracket 44, such that a portion of the leg bolt 46 extends past the hinge bracket 44 in both locations. As shown in FIG. 8, one front leg 20 and one back leg 28 are pinned to the left side of the hinge bracket 44 via one side of the leg bolt 46, and the other front leg 20 and back leg 28 are pinned to the right side of the hinge bracket 44 via the other side of the leg bolt 46. The legs 20, 28 and bracket 44 may be secured in place on the leg bolt 46 by nuts and washers.

In some embodiments, the hinge bracket 44 comprises a fixture for locking the pole 30 in a vertical position. For example, as shown in FIGS. 8 and 9A-9C, the hinge bracket 44 has a limiting pin 52 that engages two arc-shaped slots 53 located on the sides of the U-shaped hinge bracket 44. The limiting pin 52 may be wider than the U-shaped hinge bracket 44, such that it extends through the arc-shaped slots 53. In such embodiments, the ends of the limiting pin 52 pass through the slots 53 and are secured to each back leg 28, as shown in FIG. 8. The limiting pin 52 may be moved along the arc-shaped slots 53 by rotation of the hinge bracket 44 relative to the back legs 28. That is, the hinge bracket 44 is rotatable through the angle defined by the arc length of the arc-shaped slot 53.

In assembling the system 10, the pole 30 is rotated into a vertical position, as described above and with reference to FIG. 6. In some embodiments, wherein the hinge bracket 44 is U-shaped, the pole 30 is secured to the top of the hinge bracket 44. In such embodiments, the pole 30 may be rotated upwards, thereby rotating the hinge bracket 44, until the limiting pin 52 engages the end of the arc-shaped slot 53. The arc-shaped slot 53 is designed such that the terminus occurs when the pole 30 is at vertical position (i.e., approximately 90 degrees from or perpendicular to the ground). That is, the engagement of the limiting pin 52 with terminus of the arc-shaped slot 53 provides a stopping location to prevent further rotation of the pole 30.

When the limiting pin 52 engages with the terminus of the slot 53, a user may secure the bracket hinge 44 in place (and thereby securing the pole 30 in a vertical position). For example, a first spacer 48 may be welded into or otherwise attached to the hinge bracket 44 and/or the back legs 28. To secure the bracket 44 in place, a spring-loaded ball detent pin may be inserted through the first spacer 48. The spacer 48 may be made of steel or other common metals. The spacer 48 provides strength and support to the hinge bracket 44 by acting as a brace for the legs 20, 28 of the bracket 44. Further, the spacer 48 may provide a fully or partially enclosed "sleeve" that allows the user to easily slide the detent pin into the spacer 48 and maintain proper axial alignment. The detent pin may be thick enough and set such that it also provides support. Once the user assembling the system 10 inserts the detent pin, the pole 30 is fixed in an upright position, and the user may step away from the pole 30 without concern of the pole 30 falling.

Additionally or alternatively, a second spacer may be welded or otherwise attached on the hinge bracket 44. For example, and as shown in FIG. 7, a second spacer may be welded or otherwise attached on the rear side of the hinge bracket 44. (i.e., the side facing away from the backboard 38 and rim 40). The second spacer may receive a hex bolt, which is fastened to the hinge bracket 44 by a nut. In such embodiments, the detent pin only acts as a temporary stabilizing mechanism during assembly or disassembly, and the hex bolt and nut provide firmer support and securely lock the pole 30 in place. Once the bolt is secured by the nut, the process of locking the pole 30 upright is completed. This provides a tighter clearance than the aforementioned detent pin in order to provide a firm upright lock.

Figure 9A:
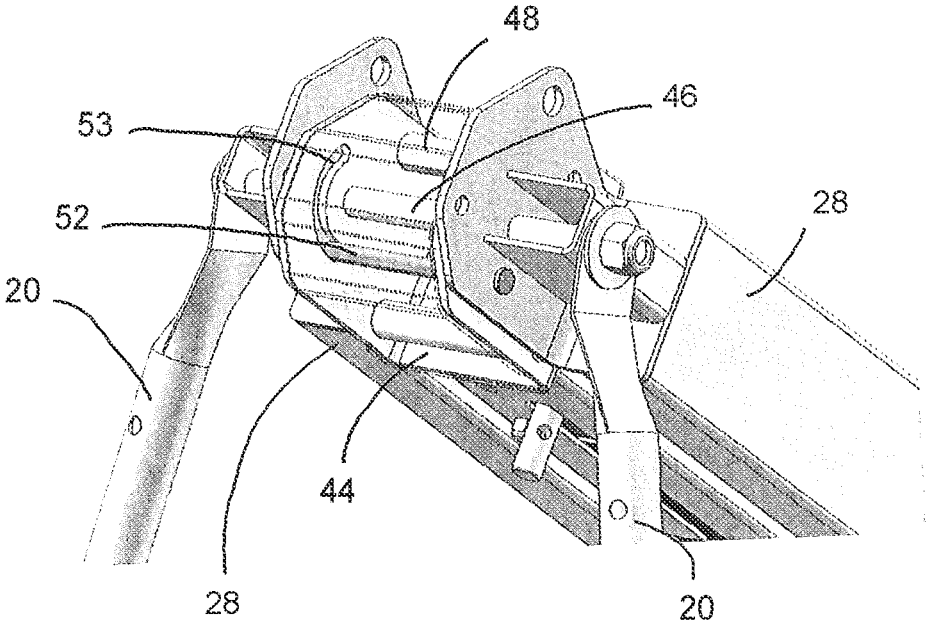
FIGS. 9A-9C depict a sequence of raising a pole and the appearance of a hinge assembly, according to an embodiment of the invention.
Figure 9B:
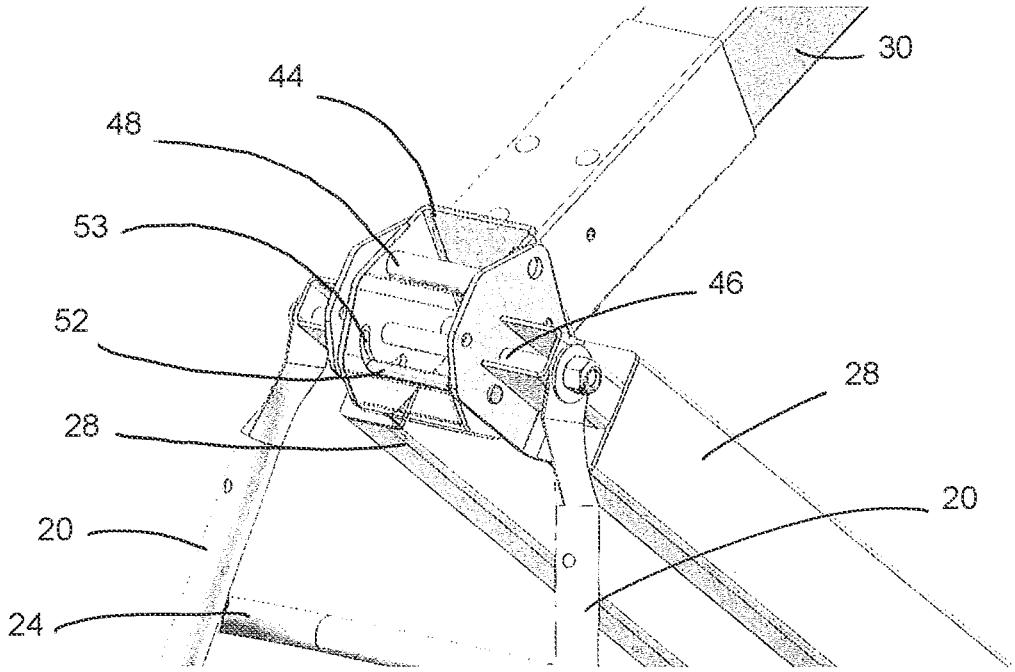
Figure 9C:
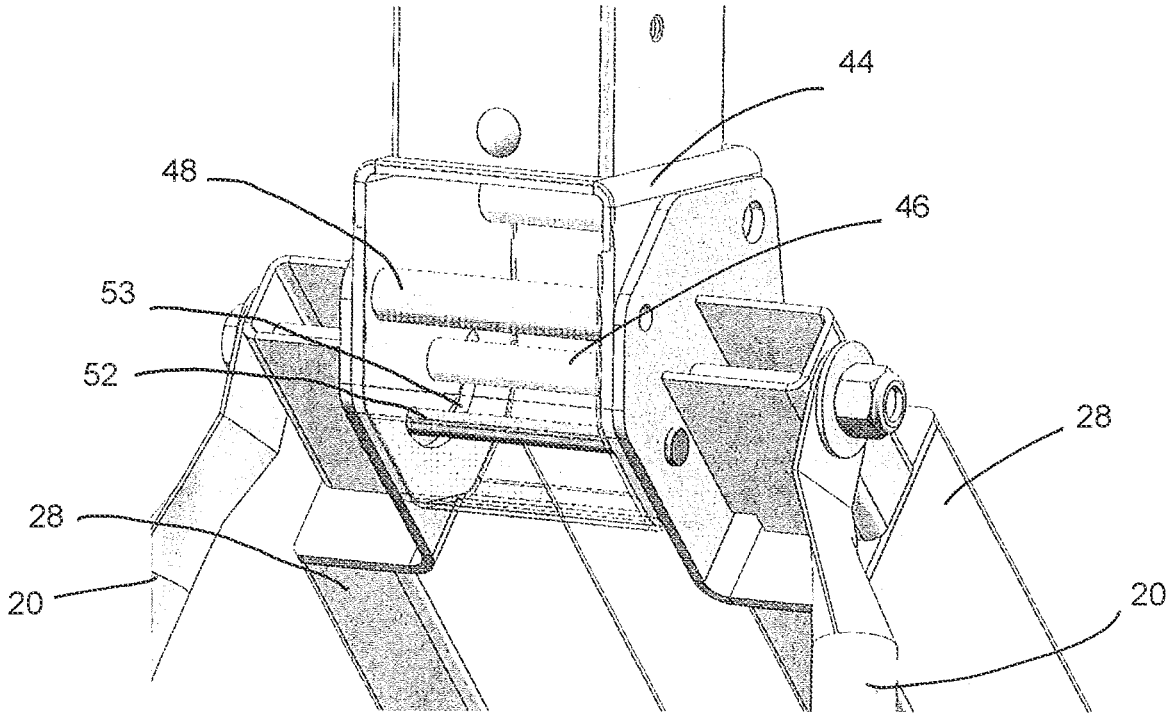

FIGS. 9A, 9B, and 9C depict the hinge assembly 26 at three different stages in the rotation of the pole 30 into an upright position. In FIG. 9A, the pole 38 is in the pre-rotation location (i.e., disposed between the back legs 28), and the limiting pin 52 is at the rear end of the arc-shaped slot 53. FIG. 9B depicts the hinge assembly 26 at a mid-point during rotation of the pole 30 to an upright position. As can be seen, the rotation of the pole 30 causes the arc-shaped slot 52 to rotate around limiting pin 52. In FIG. 9C, the pole 30 is fully vertical, and the rotation limiting pin 52 is at the front end of the arc-shaped slot 53 (i.e., at the terminus of the slot 53).

The described designs and methods have the advantage of reducing the number of parts for user assembly of the portable system 10. In particular, the embodiment depicted in FIGS. 1-7 only requires a user to make five attachments to fully assemble to system 10. These attachments include: (1) securing the extension arm 34 to the pole 30; (2) mounting the backboard 38 to the extension arm 34, (4) mounting the rim 40 to the backboard 38, and (5) securing each front leg 20 to the base 12.

It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The foregoing description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but, as mentioned above, it is to be understood that the teachings of the present disclosure are capable of use in various other combinations, modifications, and environments and are capable of changes or modifications within the scope of the teachings as expressed herein, commensurate with the skill and/or knowledge of a person having ordinary skill in the relevant art. The embodiments described hereinabove are further intended to explain certain best modes known of practicing the processes, machines, manufactures, compositions of matter, and other teachings of the present disclosure and to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. § 1.77 or otherwise to provide organizational queues. These headings shall not limit or characterize the invention(s) set forth herein.

We claim:

1. A basketball backboard system transitionable between a storage state and an assembled state, comprising:

a base having a top surface, at least one indentation in the top surface, and two base platforms, each base platform for securing a leg to the base;

a vertical support assembly completely nestable within the at least one indentation such that the vertical support assembly is flush with or below the top surface of the base in the storage state, the vertical support assembly comprising a hinge assembly, two front legs, each having a lower end detachably securable to one of the base platforms in the assembled state and an upper end secured to and rotatable about the hinge assembly when the lower end is detached from the base, two back legs, each having an upper end secured to the hinge assembly and a lower end secured to the base, and a pole having a bottom end secured to the hinge assembly and a top end;

an extension arm securable to the top end of the pole, such that the extension arm extends above the top surface of the base when secured and when the vertical support assembly is completely nested within the at least one indentation of the base;

a backboard securable to the extension arm; and a rim securable to the backboard.

2. The system of claim 1, further comprising a brace having a first end and a second end, wherein the first end is secured to a first of the two front legs and the second end is secured to a second of the two front legs.

3. The system of claim 1, wherein the base includes at least two wheels.

4. The system of claim 1, wherein the pole is telescoping.

5. The system of claim 1, wherein the hinge assembly and the pole are disposed between the back legs in the at least one indentation.

6. The system of claim 1, wherein the at least one indentation comprises a centrally disposed indentation and two side indentations disposed adjacent to and flanking the centrally disposed indentation, and wherein the back legs and the pole are nested with the centrally disposed indentation, and the front legs are separately nested into the two side indentations.

7. The system of claim 1, wherein the top end of the pole includes an attachment plate, wherein the extension arm is securable to the attachment plate.

8. The system of claim 1, wherein the extension arm comprises a first and second end, the first end being securable to the pole and the second end including a backboard attachment plate for securing the backboard.

9. The system of claim 1, wherein the hinge assembly further comprises a U-shaped hinge bracket having a top and two sides defining an opening oriented front-to-back and each side having an arc-shaped slot with an arc length defining an angle;

a rotation-limiting pin wider than the U-shaped hinge bracket, extending through each arc-shaped slot, and secured to the upper end of each back leg, such that the rotation-limiting pin is rotatable through the angle defined by the arc length of the arc-shaped slot;

a detent pin insertable through the upper ends of each back leg when the top of the hinge bracket is horizontally oriented; and a first spacer secured between the two sides of the bracket and capable of receiving the detent pin.

10. The system of claim 9, wherein the bottom end of the pole is secured to the top side of the U-shaped hinge bracket.

11. A method for assembling a basketball backboard system, the method comprising:

providing a base having a top surface, at least one indentation on the top surface, and two base platforms, wherein a vertical support assembly is completely nested in the at least one indentation such that the vertical support assembly is flush with or in a storage state, the vertical support assembly comprising a hinge assembly, two front legs, each front leg having an upper end secured to and rotatable about the hinge assembly, two back legs, each back leg having an upper end rotatably secured to the hinge assembly and a lower end secured to the base, and a pole having a bottom end secured to the hinge assembly and a top end;

securing an extension arm to the top end of the pole;

mounting a backboard to the extension arm;

mounting a rim to the backboard;

rotating the front legs to a position wherein a lower end of each front leg is securable to one of the base platforms, and the upper ends of the front legs and of the back legs and the hinge assembly is raised above the base;

securing the lower ends of the front legs to the base platforms, rotating the hinge assembly until the pole is in a vertical position; and locking the pole in a vertical position.

12. The method of claim 11, wherein the pole is telescoping, and wherein the method further comprises extending the telescoping pole to a desired rim height.

13. The method of claim 11, wherein the hinge assembly further comprises a U-shaped hinge bracket having a top and two sides defining an opening oriented front-to-back and each side having an arc-shaped slot with an arc length defining an angle;

a rotation-limiting pin wider than the U-shaped hinge bracket, extending through each arc-shaped slot, and secured to the upper end of each back leg, such that the rotation-limiting pin is rotatable through the angle defined by the arc length of the arc-shaped slot;

a detent pin insertable through the upper ends of each back leg when the top of the hinge bracket is horizontally oriented; and a first sleeve secured between the two sides of the bracket and capable of receiving the detent pin.

14. The method of claim 13, wherein the bottom end of the pole is secured to the top side of the U-shaped hinge bracket.

15. The method of claim 13, wherein the step of rotating the hinge assembly comprises moving the rotation-limiting pin through the arc-shaped slot on the hinge assembly.

16. The method of claim 13, wherein the step of locking the pole in a vertical position comprises inserting the detent pin into the first sleeve on the hinge assembly.

17. A basketball backboard system transitionable between a storage state and an assembled state, comprising:

a base having a top surface and at least one indentation in the top surface, and two base platforms, each base platform for securing a leg to the base;

a vertical support assembly completely nestable within the at least one indentation such that the vertical support assembly is flush with or below the top surface of the base in the storage state, the vertical support assembly comprising a hinge assembly, two front legs, each having a lower end detachably securable to one of the base platforms in the assembled state and an upper end secured to and rotatable about the hinge assembly when the lower end is detached from the base, two back legs, each having an upper end secured to the hinge assembly and a lower end secured to the base, and a pole having a bottom end secured to the hinge assembly and a top end;

an extension arm securable to the top end of the pole, such that the extension arm extends above the top surface of the base when secured and when the vertical support assembly is completely nested within the at least one indentation of the base;

a backboard securable to the extension arm; and a rim securable to the backboard, wherein the lower ends of the front legs are detached from the base and the vertical support assembly is nested in the at least one indentation in the storage state, wherein one or more components of the vertical support assembly extend upward from the base in the assembled state, and wherein when the basketball backboard system is transitioned from the storage state to the assembled state, the front legs are rotated about the hinge assembly.

* * * * *